US006413171B1

(12) United States Patent
Shimosaka

(10) Patent No.: US 6,413,171 B1
(45) Date of Patent: Jul. 2, 2002

(54) GOLF BALL

(75) Inventor: Hirotaka Shimosaka, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 09/635,637

(22) Filed: Aug. 10, 2000

Related U.S. Application Data

(60) Provisional application No. 60/149,463, filed on Aug. 19, 1999.

(30) Foreign Application Priority Data

Aug. 19, 1999 (JP) ..... 11-232620

(51) Int. Cl.[7] ..... A63B 37/12; A63B 37/14; A63B 37/00

(52) U.S. Cl. ..... 473/378; 473/351

(58) Field of Search ..... 473/351, 365, 473/371, 376, 377, 378, 379, 380, 381, 382, 383, 384

(56) References Cited

U.S. PATENT DOCUMENTS

| | | | | | |
|---|---|---|---|---|---|
| 4,720,111 | A | * | 1/1988 | Yamada | 473/382 |
| 4,729,567 | A | * | 3/1988 | Oka et al. | 473/384 |
| 4,813,677 | A | * | 3/1989 | Oka et al. | 473/384 |
| 5,308,076 | A | * | 5/1994 | Sun | 473/384 |
| 5,415,410 | A | * | 5/1995 | Aoyama | 473/382 |
| 5,421,580 | A | * | 6/1995 | Sugimoto et al. | 473/354 |
| 5,433,447 | A | * | 7/1995 | Pocklington | 473/377 |
| 5,467,994 | A | * | 11/1995 | Moriyama et al. | 473/354 |
| 5,516,110 | A | * | 5/1996 | Yabuki et al. | 473/372 |
| 5,518,246 | A | * | 5/1996 | Moriyama et al. | 473/384 |
| 5,536,013 | A | * | 7/1996 | Pockington | 473/384 |
| 5,552,190 | A | * | 9/1996 | Maruoka et al. | 473/457 |
| 5,564,708 | A | * | 10/1996 | Hwang | 473/382 |
| 5,566,943 | A | * | 10/1996 | Boehm | 473/384 |
| 5,601,503 | A | * | 2/1997 | Yamagishi et al. | 473/384 |
| 5,653,648 | A | * | 8/1997 | Thurman | 473/384 |
| 5,720,676 | A | * | 2/1998 | Shimosaka et al. | 473/384 |
| 5,722,903 | A | * | 3/1998 | Moriyama et al. | 473/384 |
| 5,730,664 | A | * | 3/1998 | Asakura et al. | 473/373 |
| 5,735,757 | A | * | 4/1998 | Moriyama | 473/384 |
| 5,743,818 | A | * | 4/1998 | Maruoka et al. | 473/378 |
| 5,752,889 | A | * | 5/1998 | Yamagishi et al. | 473/377 |
| 5,759,116 | A | * | 6/1998 | Kasasima et al. | 473/384 |
| 5,779,563 | A | * | 7/1998 | Yamagishi et al. | 473/371 |
| 5,782,702 | A | * | 7/1998 | Yamagishi et al. | 473/280 |
| 5,782,703 | A | * | 7/1998 | Yamagishi et al. | 473/280 |
| 5,813,924 | A | * | 9/1998 | Yamagishi et al. | 473/377 |
| 5,827,135 | A | * | 10/1998 | Shimosaka et al. | 473/379 |
| 5,836,832 | A | * | 11/1998 | Boehm et al. | 473/354 |
| 5,857,924 | A | * | 1/1999 | Miyagawa et al. | 473/365 |
| 5,863,264 | A | * | 1/1999 | Yamagishi et al. | 473/377 |
| 5,876,294 | A | * | 3/1999 | Yamagishi et al. | 473/374 |
| 5,902,193 | A | * | 5/1999 | Shimosaka et al. | 473/384 |
| 5,906,551 | A | * | 5/1999 | Kasashima et al. | 473/384 |
| 5,908,359 | A | * | 6/1999 | Shimosaka et al. | 473/384 |
| 5,916,044 | A | * | 6/1999 | Shimosaka et al. | 473/384 |
| 5,935,023 | A | * | 8/1999 | Machara et al. | 473/384 |
| 5,957,787 | A | * | 9/1999 | Hwang | 473/379 |
| 5,967,908 | A | * | 10/1999 | Yamagishi et al. | 473/373 |

OTHER PUBLICATIONS

Flashman, M., "V.D. Other Methods of Estimating the Definite Integral (Abridged)", Copyright 2000. (www.humboldt.edu/–met2/book/ch5/CH5DSIMP.htm).*

* cited by examiner

*Primary Examiner*—Paul T. Sewell
*Assistant Examiner*—Alvin A. Hunter, Jr.
(74) *Attorney, Agent, or Firm*—Sughrue Mion, PLLC

(57) ABSTRACT

A golf ball having a plurality of dimples formed in its surface is characterized in that the sum of high-speed region dimple operative volumes of respective dimples is 210 to 310.

17 Claims, 3 Drawing Sheets

GOLF BALL

CROSS REFERENCE TO RELATED APPLICATION

This application is an application filed under 35 U.S.C. §111(a) claiming benefit pursuant to 35 U.S.C §119(e)(i) of the filing date of the Provisional Application 60/149,463 filed on Aug. 19, 1999 pursuant to 35 U.S.C. §111(b).

BACKGROUND OF THE INVENTION

1. Field of the Invention

This invention relates to golf balls (including solid golf balls and wound golf balls).

2. Prior Art

The most requisite characteristic for golf balls is a long flight distance. Heretofore, a number of proposals have been made for the purpose of increasing flight distance. However, most of the proposals intend to increase the flight distance in the high-speed region of high head speeds while little attention is paid to the flight distance in the low-speed region of low head speeds. As a consequence, there is a tendency that the ball receives favorable lift and drag in the high-speed region, but in the low-speed region, the ball receives a drastically increased drag so that the ball becomes unstable on fall, or a drastically decreased lift so that the ball drops.

In this regard, golf balls targeted for players with a relatively low head speed for ensuring increased flight distance were proposed. These golf balls, however, tend to sky in the high-speed region because of the excessive lift.

As understood from above, it occurred to few engineers in the art to develop a golf ball adapted to receive optimum lift and drag over a wide range from low to high-speed regions, especially by paying attention to the dimples that affect the lift and drag on the ball.

SUMMARY OF THE INVENTION

Therefore, an object of the invention is to provide a golf ball adapted to receive stable satisfactory lift and drag over a wide range from low to high-speed regions and travel a satisfactory distance at both low and high head speeds.

Making extensive investigations in order to achieve the above object and analyzing numerous data, the inventor discovered that although various proposals were made regarding the overall dimple volume and other indexes associated with the design of dimples, merely specifying the overall dimple volume failed to afford satisfactory lift and drag over a wide range from low to high-speed regions. With the discovery that when one dimple is considered, the influence on lift and drag of a small-diameter portion on the bottom side differs from the influence on lift and drag of a large-diameter portion on the upper side, the inventor has found that it is effective to introduce the concept of dimple operative volumes which are obtained by assuming different dimple operative coefficients to the large-diameter portion on the upper side and the small-diameter portion on the bottom side and multiplying the volumes of the large-diameter portion and small-diameter portion by the respective coefficients.

Making further investigations, the inventor has found that even the identical dimple has different dimple operative coefficients between the high-speed region with head speeds above 46 m/s and the low-speed region with head speeds below 38 m/s; that when the dimple operative volume of each dimple is determined by setting the dimple operative coefficients for the high-speed region and the low-speed region at specific values as will be described later, slicing the dimple as will be described later, and multiplying the volume of a slice by the coefficient, the sum of dimple operative volumes for all the dimples is set to fall within a specific range, and especially the sum of high-speed region dimple operative volumes obtained using the dimple operative coefficients for the high-speed region is set to fall within a specific range, whereby stable satisfactory lift and drag are available over a wide range from low to high-speed regions. It has also been found that when the sum of low-speed region dimple operative volumes is set to fall within a specific range, more preferably when the ratio of the sums of dimple operative volumes is set to fall within a specific range, and when along with the foregoing factors, the overall dimple volume is optimized, the above effects are more advantageously achieved.

Therefore, the invention provides a golf ball as defined below.

(1) A golf ball having a plurality of dimples formed in its surface, characterized in that the sum of high-speed region dimple operative volumes of respective dimples as calculated by the method to be described later is 210 to 310.

(2) The golf ball of (1) wherein the sum of low-speed region dimple operative volumes of respective dimples as calculated by the method to be described later is 210 to 310.

(3) The golf ball of (2) wherein the ratio of the sum of high-speed region dimple operative volumes to the sum of low-speed region dimple operative volumes is from 0.8/1 to 1.0/1.

(4) The golf ball of any one of (1) to (3) wherein the overall dimple volume is 250 to 400 $mm^3$.

(5) The golf ball of any one of (1) to (4) comprising a solid core formed of a rubber composition to a diameter of 34 to 40 mm and a cover enclosing the core.

(6) The golf ball of (5) wherein the cover has two or three layers.

DETAILED DESCRIPTION OF THE INVENTION

Figure 1:
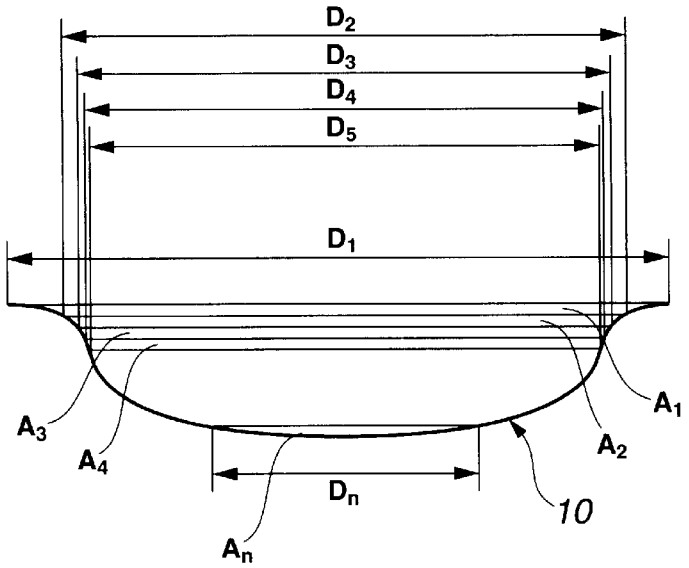
FIG. 1 is a diagram illustrating how to calculate HDOV and LDOV according to the present invention.

Now the present invention is described in further detail.

The golf ball of the invention has a plurality of dimples formed in its surface. The sum of high-speed region dimple operative volumes of respective dimples as calculated by the following method is at least 210, preferably at least 220 and up to 310, preferably up to 270, more preferably up to 240. It is understood that the high-speed region dimple operative volume of an individual dimple is designated HDOV, and the sum of these volumes is designated overall HDOV.

Method of Calculating a High-speed Region Dimple Operative Volume

It is assumed that a dimple has a diameter $D_1$ (mm). A diameter range $R_1$ containing the diameter $D_1$ is determined from Table 1. The dimple is horizontally sliced at the position of a depth corresponding to a diameter $D_2$ (mm) equal to the lower limit of the diameter range $R_1$, to define a first slice zone $A_1$ of flat frustoconical shape having the diameters $D_1$ and $D_2$. The volume ($mm^3$) of the slice zone $A_1$ is multiplied by a coefficient $\alpha_1$ corresponding to the diameter range $R_1$ given in Table 1 to calculate a first imaginary slice volume $V_1$ ($mm^3$). Next, the dimple is horizontally sliced at the position of a depth corresponding to a diameter $D_3$ (mm) equal to the lower limit of the diameter range $R_2$ which is given one row below the preceding diameter range $R_1$ in Table 1, to define a second slice zone $A_2$ of flat frustoconical shape having the diameters $D_2$ and $D_3$. The volume ($mm^3$) of the slice zone $A_2$ is multiplied by a coefficient $\alpha_2$ corresponding to the diameter range $R_2$ given in Table 1 to calculate a second imaginary slice volume $V_2$ ($mm^3$). Calculation is similarly repeated until the volume ($mm^3$) of the slice zone $A_n$ associated with the final diameter range $R_n$ with a diameter of less than 2 mm is multiplied by a coefficient $\alpha_n$ corresponding to the diameter range $R_n$ to calculate a n-th imaginary slice volume $V_n$ ($m^3$). The foregoing imaginary slice volumes are summed to give the high-speed region dimple operative volume HDOV.

$$HDOV\ (\mathrm{mm}^3)=V_3+V_2+\ldots+V_n$$

TABLE 1

Coefficients for the calculation of dimple operative volumes

| No. | Diameter range R (mm) | Coefficient α |
|---|---|---|
| 1 | ≧4.4 | 1.00 |
| 2 | 4.2–4.4 | 1.00 |
| 3 | 4.0–4.2 | 1.00 |
| 4 | 3.8–4.0 | 1.00 |
| 5 | 3.6–3.8 | 0.95 |
| 6 | 3.4–3.6 | 0.90 |
| 7 | 3.2–3.4 | 0.85 |
| 8 | 3.0–3.2 | 0.80 |
| 9 | 2.8–3.0 | 0.70 |
| 10 | 2.6–2.8 | 0.60 |
| 11 | 2.4–2.6 | 0.50 |
| 12 | 2.2–2.4 | 0.40 |
| 13 | 2.0–2.2 | 0.30 |
| 14 | ≦2.0 | 0.20 |

An overall HDOV below the above-defined range allows the ball to sky when hit at high head speeds whereas an overall HDOV above the above-defined range yields a low trajectory. Either case leads to a shortage of flight distance.

In one preferred embodiment of the invention, the sum of low-speed region dimple operative volumes of respective dimples as calculated by the following method is at least 210, preferably at least 230, more preferably at least 250 and up to 310, preferably up to 300, more preferably up to 270. It is understood that the low-speed region dimple operative volume of an individual dimple is designated LDOV, and the sum of these volumes is designated overall LDOV.

Method of Calculating a Low-speed Region Dimple Operative Volume

It is assumed that a dimple has a diameter $D_1$ (mm). A diameter range $R_1$ containing the diameter $D_1$ is determined from Table 2. The dimple is horizontally sliced at the position of a depth corresponding to a diameter $D_2$ (mm) equal to the lower limit of the diameter range $R_1$, to define a first slice zone $A_1$ of flat frustoconical shape having the diameters $D_1$ and $D_2$. The volume ($mm^3$) of the slice zone $A_1$ is multiplied by a coefficient $\beta_1$ corresponding to the diameter range $R_1$ given in Table 2, to calculate a first imaginary slice volume $v_1$ ($mm^3$). Next the dimple is horizontally sliced at the position of a depth corresponding to a diameter $D_3$ (mm) equal to the lower limit of the diameter range $R_2$ which is given one row below the preceding diameter range $R_1$ in Table 2, to define a second slice zone $A_2$ of flat frustoconical shape having the diameters $D_2$ and $D_3$. The volume ($mm^3$) of the slice zone $A_2$ is multiplied by a coefficient $\beta_2$ corresponding to the diameter range $R_2$ given in Table 2 to calculate a second imaginary slice volume $v_2$ ($mm^3$). The calculation is repeated until the volume ($mm^3$) of the slice zone $A_n$ associated with the final diameter range $R_n$ with a diameter of less than 2 mm is multiplied by a coefficient $\beta_n$ corresponding to the diameter range $R_n$ to calculate a n-th imaginary slice volume $v_n$ ($mm^3$). The foregoing imaginary slice volumes are summed to give the low-speed region dimple operative volume LDOV.

$$LDOV(\mathrm{mm}^3)=v_1+v_2+\ldots+v_n$$

TABLE 2

Coefficients for the calculation of dimple operative volumes

| No. | Diameter range R (mm) | Coefficient β |
|---|---|---|
| 1 | ≧4.4 | 0.10 |
| 2 | 4.2–4.4 | 0.20 |
| 3 | 4.0–4.2 | 0.40 |
| 4 | 3.8–4.0 | 0.60 |
| 5 | 3.6–3.8 | 0.70 |
| 6 | 3.4–3.6 | 0.80 |
| 7 | 3.2–3.4 | 0.90 |
| 8 | 3.0–3.2 | 0.95 |
| 9 | 2.8–3.0 | 1.00 |
| 10 | 2.6–2.8 | 1.00 |
| 11 | 2.4–2.6 | 0.90 |
| 12 | 2.2–2.4 | 0.80 |
| 13 | 2.0–2.2 | 0.70 |
| 14 | ≦2.0 | 0.50 |

It is likely to occur that an overall LDOV below the above-defined range allows the ball to sky when hit at low heads speeds whereas an overall LDOV above the above-defined range yields a low trajectory and a short flight distance.

Further, the ratio of the overall HDOV to the overall LDOV is preferably at least 0.8, especially at least 0.82 and up to 1.0, especially up to 0.95. If this ratio is too low, the all tends to reduce flight distance when hit at high head speeds. Inversely, if this ratio is too high, the ball tends to reduce flight distance when hit at low head speeds.

Now referring to FIG. 1, the methods of calculating HDOV and LDOV are described in further detail. It is assumed that a dimple 10 has a diameter $D_1$ mm. A diameter range $R_1$ containing this diameter $D_1$ is determined from Table 1 or 2. For a dimple having a diameter of 4.1 mm, for example, its diameter range is range No. 3 in Table 1 or 2. The dimple is horizontally divided or sliced at the position of a depth corresponding to a diameter $D_2$ mm equal to the lower limit of the diameter range $R_1$ (the lower limit of range No. 3 for the diameter of 4.1 mm is 4.0 mm), to define a first slice zone $A_1$ of flat frustoconical shape having the diameters $D_1$ and $D_2$ (diameters 4.1 mm and 4.0 mm in the illustrated example). The volume $B_1$ $mm^3$ of the slice zone $A_1$ is determined, and this volume $B_1$ is multiplied by a coefficient corresponding to the diameter range $R_1$, that is, $\alpha_1$ in the case of HDOV or $\beta_1$ in the case of LDOV, to calculate a first imaginary slice volume $V_1$ $mm^3$ in the case of HDOV or $v_1$ in the case of LDOV. Specifically in the illustrated example, the coefficient for diameter range No. 3 is 1.00 in the case of HDOV and 0.40 in the case of LDOV, and the volume $B_1$ mm$^3$ is multiplied by these coefficients to calculate first imaginary slice volumes $V_1$ mm$^3$ and $v_1$ mm$^3$, respectively.

Next, the dimple is horizontally sliced at the position of a depth corresponding to a diameter $D_3$ mm equal to the lower limit of the diameter range $R_2$ which is given one row below the preceding diameter range $R_1$ in Table 1 or 2 (in the illustrated example, the diameter range $R_2$ is diameter range No. 4 which is given one row below diameter range No. 3, and the diameter $D_3$ is 3.8 mm which is the lower limit of diameter range No. 4), to define a second slice zone $A_2$ of flat frustoconical shape having the diameters $D_2$ and $D_3$ (diameters 4.0 mm and 3.7 mm in the illustrated example). The volume $B_2$ mm$^3$ of the slice zone $A_2$ is determined and, this volume $B_2$ mm$^3$ is multiplied by a coefficient $\alpha_2$ (in the case of HDOV) or $\beta_2$ (in the case of LDOV) corresponding to the diameter range $R_2$ to calculate a second imaginary slice volume $V_2$ mm$^3$ or $v_2$ mm$^3$. Specifically in the illustrated example, the coefficient for diameter range No. 4 is 1.00 in the case of HDOV and 0.60 in the case of LDOV, and the volume $B_2$ mm$^3$ is multiplied by these coefficients to calculate second imaginary slice volumes $V_2$ mm$^3$ and $v_2$ mm$^3$, respectively.

The same calculation procedure as above is repeated until diameter range No. 13. The imaginary slice volumes $V_3$ mm$^3$, $V_4$ mm$^3$, and so on (in the case of HDOV) and the imaginary slice volumes $v_3$ mm$^3$, $v_4$ mm$^3$, and so on (in the case of LDOV) for respective diameter ranges are calculated.

For the final diameter range $R_n$, that is, diameter range No. 14 with a diameter of less than 2 mm, the volume $B_n$ mm$^3$ of the slice zone $A_n$ is similarly determined. The volume $B_n$ mm$^3$ is multiplied by a coefficient $\alpha_n$ or $\beta_n$ corresponding to the diameter range, specifically a coefficient of 0.20 in the case of HDOV or 0.50 in the case of LDOV, to calculate imaginary slice volume $V_n$ mm$^3$ in the case of HDOV or $v_n$ mm$^3$ in the case of LDOV.

HDOV of the above-specified dimple is the sum of imaginary slice volumes $V_1, V_2, V_3, V_4, \ldots, V_n$ mm$^3$ of respective slice zones $A_1, A_2, A_3, A_4, \ldots, A_n$; and LDOV is the sum of imaginary slice volumes $v_1, v_2, v_3, v_4, \ldots, v_n$ mm$^3$ of respective slice zones $A_1, A_2, A_3, A_4, \ldots, A_n$, as represented by the following equations.

$$HDOV(\text{mm}^3)=V_1+V_2+V_3+V_4+\ldots+V_n$$

$$LDOV(\text{mm}^3)=v_1+v_2+v_3+V_4+\ldots+v_n$$

The sum of HDOV's thus calculated for respective dimples is the overall HDOV, and the sum of LDOV's calculated for respective dimples is the overall LDOV.

Figure 2:
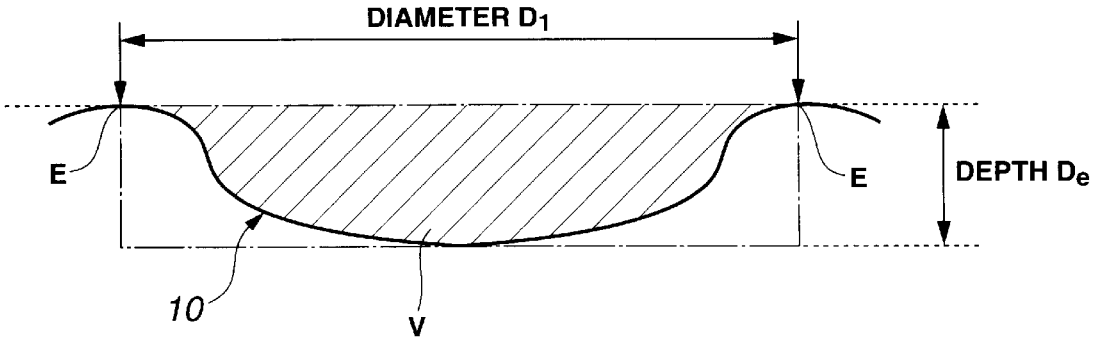
FIG. 2 is a diagram illustrating a dimple shape in the invention.

According to the invention, in an elevational cross section taken at the center of a dimple 10 as shown in FIG. 2 wherein the left and right highest points in the figure are positioned on a horizontal line and these highest points are designated dimple edges E and E, the dimple 10 has a diameter $D_1$ which is equal to the distance between the dimple edges E and E. The dimple 10 has a depth De which is equal to the distance from a line segment connecting the edges E and E to the deepest bottom of the dimple. Then the dimple has a volume V which is the volume of a dimple portion delimited by the edges. It is understood that the dimple volume V mm$^3$ is the sum of volumes $B_1, B_2, B_3, B_4, \ldots, B_n$ mm$^3$ of respective slice zones $A_1, A_2, A_3, A_4, \ldots, A_n$.

$$V(\text{mm}^3)=B_1+B_2+B_3+B_4+\ldots+B_n$$

Also, the overall dimple volume is the sum of volumes of respective dimples.

It is noted that the horizontal direction assumed in the methods of calculating HDOV and LDOV designates a direction parallel to a line connecting the dimple edges E and E in FIG. 2.

According to the invention, the overall dimple volume is preferably at least 250 mm$^3$, more preferably at least 280 mm, further preferably at least 300 mm$^3$ and up to 400 mm$^3$, more preferably up to 380 mm$^3$, further preferably up to 360 mm$^3$, most preferably up to 330 mm$^3$. With too small an overall dimple volume, the ball tends to fly with a skying trajectory that is insufficient to gain a run and readily affected by the wind. Inversely, with too large an overall dimple volume, the ball tends to fly with a too low trajectory to a short carry and fluctuate.

It is noted that the shape of dimples used herein is generally circular in plane. Preferably the dimples have a diameter of at least 1.8 mm, more preferably at least 2.4 mm, further preferably at least 3.0 mm and up to 4.6 mm, more preferably up to 4.4 mm, further preferably up to 4.2 mm. Preferably the dimples have a depth of at least 0.08 mm, more preferably at least 0.10 mm, further preferably at least 0.12 mm and up to 0.22 mm, more preferably up to 0.20 mm, further preferably up to 0.19 mm.

The total number of dimples (n) is from 360 to 540. More preferably, the total number of dimples is at least 380, further preferably at least 390 and at most 450, further preferably at most 400. Preferred for the dimples used herein are combinations of dimples of at least two types, more preferably at least three types, further preferably at least four types, which are different in diameter, and up to six types, especially up to five types which are different in diameter. These dimples may also be different in depth. Therefore, combinations of dimples of at least three types, especially at least four types and up to ten types, especially up to eight types which are different in diameter and/or depth are preferable.

For the arrangement of the above-described dimples, any well-known technique may be used, and no particular limit is imposed as long as the dimples are evenly distributed. There may be employed any of the octahedral arrangement, icosahedral arrangement, and sphere division techniques of equally dividing a hemisphere into 2 to 6 regions wherein dimples are distributed in the divided regions. Fine adjustments or modifications may be made on these techniques. It is also preferred herein that the dimple surface coverage is 69 to 82%, especially 72 to 77%.

The golf ball of the invention may be either a solid golf ball or a wound golf ball. Accordingly, the core may be either a solid core or a wound core. The invention is applicable to any prior art well-known core although the invention is preferably applicable to a solid golf ball.

Here the solid golf ball may be one comprising a core and a cover. It is preferred from the standpoint of advantageously attaining the object of the invention that the core is formed of a rubber composition and has a diameter of 34 to 40 mm, especially 34 to 38 mm.

The rubber composition used herein is preferably one using polybutadiene as the base. One preferred example of the polybutadiene is 1,4-cis-polybutadiene having at least 40% of cis structure. In the base rubber, natural rubber, polyisoprene rubber, styrene-butadiene rubber or the like may be suitably blended with the polybutadiene, if desired. By increasing the rubber component, the resilience of the golf ball is improved.

Also in the rubber composition, there may be blended a zinc or magnesium salt of an unsaturated fatty acid such as zinc methacrylate or zinc acrylate, or an ester such as trimethylpropane methacrylate as a crosslinking agent. In particular, zinc acrylate is preferably used. The amount of the crosslinking agent blended is preferably from 10 to 30 parts by weight per 100 parts by weight of the base rubber.

In the rubber composition, a vulcanizing agent is usually blended. It is recommended that the vulcanizing agent contains a peroxide in which the temperature giving a half-life period of 1 minute is up to 155° C. The content of the peroxide is at least 30%, especially at least 40% by weight of the entire vulcanizing agent while the upper limit of the content is not critical, but is preferably up to 70% by weight. Such peroxides are commercially available, for example, under the tradename of Perhexa 3M (Nippon Oil and Fats K.K.). The amount of the vulcanizing agent blended is preferably from 0.6 to 2 parts by weight per 100 parts by weight of the base rubber.

Further, if necessary, an antioxidant and zinc oxide or barium sulfate as a filler for specific gravity adjustment may be blended.

The rubber composition may be vulcanized and cured by well-known techniques, producing a solid core. The solid core preferably has a diameter of at least 34 mm, especially at least 35 mm and up to 40 mm, more preferably up to 38 mm, further preferably up to 37 mm.

Also, the cover may be of any prior art well-known cover construction. It may be a single cover although a multilayer cover construction consisting of two or three or more layers is preferable from the standpoints of a lower spin rate upon driver shots and a higher spin rate upon approach shots.

In this embodiment of the invention, the outermost layer cover preferably has a gage (or thickness) of at least 1.0 mm, especially at least 1.4 mm and up to 2.0 mm, especially up to 1.7 mm and a Shore D hardness of at least 40, more preferably at least 43, further preferably at least 44 and up to 52, more preferably up to 50, further preferably up to 47. With a too small gage, the ball can become less durable whereas a too large gage can lead to a drop of resilience. A too low Shore D hardness can lead to a drop of resilience and shortage of parting smoothness during ball molding whereas a too high Shore D hardness tends to give a hard feel and a lower spin rate upon approach shots.

In the embodiment wherein the cover consists of plural layers, a cover layer next to the outermost layer should preferably have a gage (or thickness) of at least 1.0 mm, especially at least 1.4 mm and up to 2.0 mm, especially up to 1.7 mm. With a too small gage, the ball can become less durable whereas a too large gage can lead to a drop of resilience.

The overall gage of the cover is preferably at least 2.0 mm, especially at least 2.6 mm and up to 4.0 mm, especially up to 3.4 mm.

The cover may be formed of well-known cover-forming thermoplastic resins such as ionomer resins, thermoplastic polyurethane elastomers, and thermoplastic polyester elastomers.

Here, the cover layer next to the outermost layer or the inside cover enclosing the core is preferably formed of thermoplastic resins, for example, well-known thermoplastic resins and thermoplastic elastomers. Illustrative examples include nylon, polyarylates, ionomer resins, polypropylene resins, thermoplastic polyurethane elastomers, and thermoplastic polyester elastomers. Exemplary commercially available products include Surlyn AD 8512 (ionomer resin by Dupont), Himilan 1706 and 1707 (ionomer resins by Mitsui Dupont Polychemical K.K.), Rilsan BMNO (polyamide resin by Elf Atochem), and U Polymer U-8000 (polyarylate resin by Unitika K.K.). Ionomer resins are especially preferred. It is desired that the cover layer next to the outermost layer or the inside cover has a gage of 1.0 to 2.0 mm, more desirably 1.4 to 1.7 mm, and a Shore D hardness of 50 to 63, more desirably 54 to 60, most desirably 55 to 57.

The golf ball of the invention is generally completed as a product by further coating the cover with a paint. It is preferable from the standpoints of feel and resilience that the golf ball of the invention is formed so as to experience a compression deformation (referred to as $\mu$ hardness, hereinafter) of 2.6 to 3.4 mm when the load which varies from an initial load of 10 kg to a final load of 130 kg is applied to the ball. With too low a $\mu$ hardness, the feel, especially upon shots causing significant deformation to the ball such as driver shots can sometimes be hard. Inversely, too high a $\mu$ hardness would sometimes fail to provide sufficient resilience.

The diameter and weight of the golf ball of the invention comply with the Rules of Golf. From the standpoint of improving flight performance, the ball is formed to a diameter of 42.67 to 42.97 mm. The weight is preferably 44.9 to 45.9 grams.

The invention ensures the efficient manufacture of a golf ball which will travel a satisfactory flight distance over a wide range from low to high-speed regions.

EXAMPLE

Examples and Comparative Examples are given below for illustrating the invention, but the invention is not limited to the following Examples.

Examples & Comparative Examples

Solid cores were prepared by a conventional process using the composition shown in Table 3.

The cores each were then enclosed in an inside cover and an outside cover as shown in Table 3.

TABLE 3

| | | |
|---|---|---|
| Core | Polybutadiene | 100.0 pbw |
| | Dicumyl peroxide | 1.2 pbw |
| | Barium sulfate | 13.1 pbw |
| | Zinc white | 5.0 pbw |
| | Antioxidant | 0.2 pbw |
| | Zinc salt of pentachlorothiophenol | 1.0 pbw |
| | Zinc diacrylate | 27.4 pbw |
| | Diameter (mm) | 36.4 |
| Inside cover | Dynalon 6100P | 30.0 pbw |
| | Surlyn AD8511 | 35.0 pbw |
| | Surlyn AD8512 | 35.0 pbw |
| | Titanium dioxide | 5.1 pbw |
| | Gage (mm) | 1.65 |
| | Shore D hardness | 56 |
| Outside cover | PANDEX TR3080 | 50.0 pbw |
| | PANDEX T7298 | 50.0 pbw |
| | Titanium dioxide | 2.7 pbw |
| | Gage (mm) | 1.5 |
| | Shore D hardness | 45 |

Figure 3:
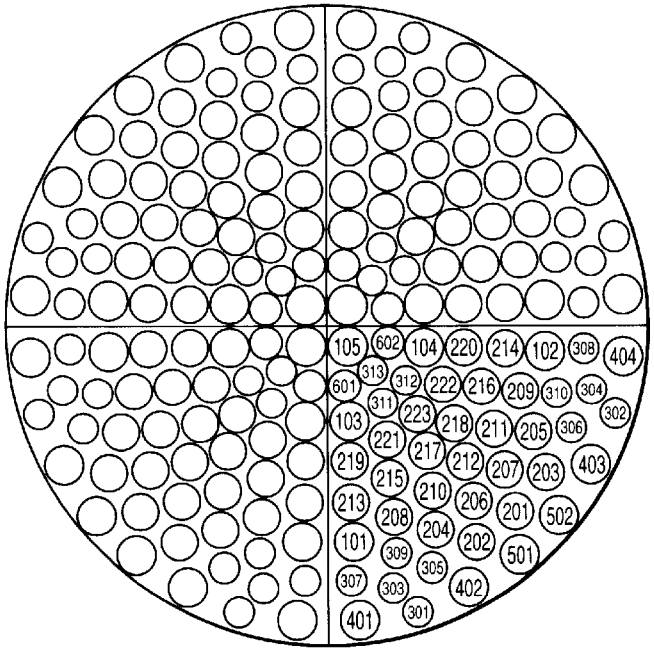
FIG. 3 is a diagram illustrating the arrangement of dimples on the golf balls of Examples 1 to 4 and Comparative Example 1.
Figure 4:
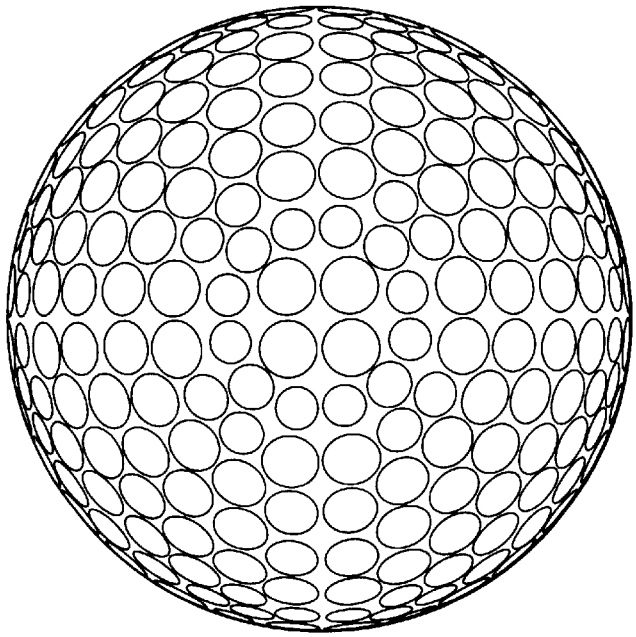
FIG. 4 is a plan view of the same golf ball.
Figure 5:
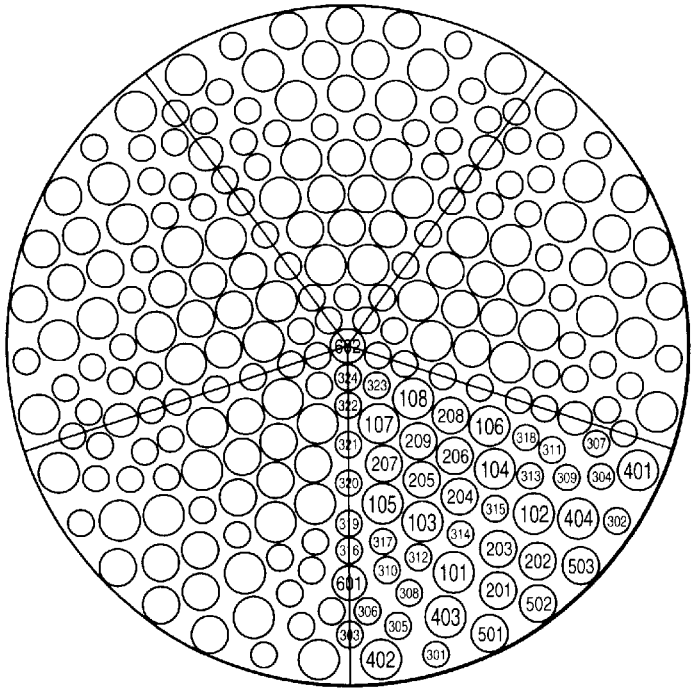
FIG. 5 is a diagram illustrating the arrangement of dimples on the golf ball of Comparative Example 2.
Figure 6:
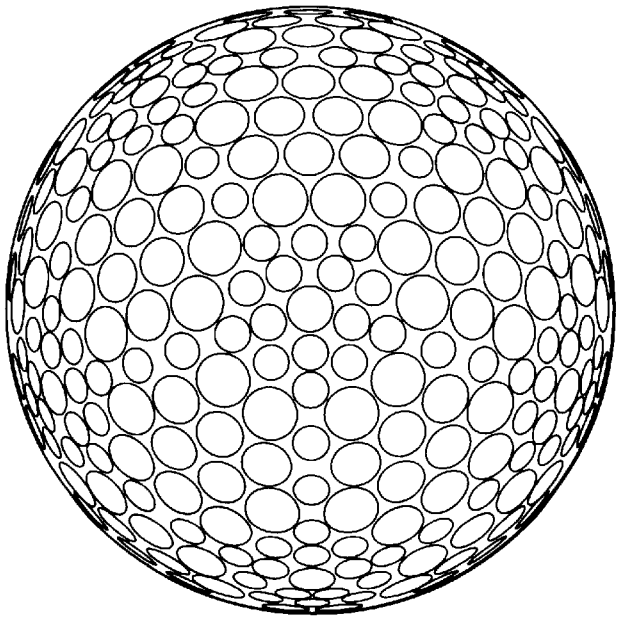
FIG. 6 is a plan view of the same golf ball.

Note:
Dynalon: Japan Synthetic Rubber K.K., block copolymer, hydrogenated butadiene-styrene copolymer
Surlyn: Dupont, ionomer resin
PANDEX: Dainippon Ink & Chemicals K.K., thermoplastic polyurethane elastomer The golf balls were provided on their surface with dimples as shown in Table 4 in the arrangement shown in FIGS. 3 and 4. It is noted that Comparative Example 2 employed the arrangement shown in FIGS. 5 and 6. In the figures, the dimples labeled 100s designate dimples (1), the dimples labeled 200*s* designate dimples (2), and the dimples labeled 300*s* designate dimples (3) in Table 4 (and so forth).

A flight test was carried out on the thus obtained golf balls by the following procedure. The results are also shown in Table 4.

Flight test

Using a swing robot manufactured by Miyamae K.K., 20 balls of each Example were hit with a driver. An elevation angle (angle in height direction relative to the horizontal), carry and total distance were measured.

Club used

Head speed 50 m/s

Head: manufactured by Bridgestone Sports Co., Ltd., J's METAL, loft angle 7.5°, lie angle 57°, SUS630 stainless steel, lost wax process Shaft: Harmotech Pro, HM-70, LK (low kick point), hardness X Head speed 35 m/s Head: manufactured by Bridgestone Sports Co., Ltd., J's METAL, loft angle 9.5°, lie angle 57°, SUS630 stainless steel, lost wax process Shaft: Harmotech Pro, HM-70, LK (low kick point), hardness X

TABLE 4

| | | | Example 1 | Example 2 | Example 3 | Example 4 | Comparative Example 1 | Comparative Example 2 |
|---|---|---|---|---|---|---|---|---|
| Dimple (1) | Dimple number | | 40 | 40 | 40 | 40 | 40 | 80 |
| | Diameter (mm) | | 4.02 | 4.00 | 4.00 | 4.04 | 3.98 | 4.10 |
| | Depth (mm) | | 0.16 | 0.17 | 0.18 | 0.19 | 0.20 | 0.18 |
| | Volume ($mm^3$) | | 1.05 | 1.04 | 1.16 | 1.04 | 1.03 | 1.13 |
| | HDOV ($mm^3$) | | 0.84 | 0.82 | 0.92 | 0.80 | 0.70 | 0.87 |
| | LDOV ($mm^3$) | | 0.84 | 0.85 | 0.94 | 0.83 | 0.86 | 0.90 |
| Dimple (2) | Dimple number | | 184 | 184 | 184 | 184 | 184 | 90 |
| | Diameter (mm) | | 3.88 | 3.90 | 3.90 | 3.90 | 3.90 | 3.66 |
| | Depth (mm) | | 0.15 | 0.16 | 0.17 | 0.18 | 0.19 | 0.17 |
| | Volume ($mm^3$) | | 0.86 | 0.89 | 0.98 | 0.87 | 0.93 | 0.86 |
| | HDOV ($mm^3$) | | 0.64 | 0.67 | 0.73 | 0.61 | 0.62 | 0.56 |
| | LDOV ($mm^3$) | | 0.73 | 0.75 | 0.83 | 0.72 | 0.86 | 0.74 |
| Dimple (3) | Dimple number | | 104 | 104 | 104 | 104 | 104 | 240 |
| | Diameter (mm) | | 3.08 | 3.20 | 3.10 | 3.08 | 3.10 | 2.60 |
| | Depth (mm) | | 0.13 | 0.14 | 0.15 | 0.15 | 0.14 | 0.15 |
| | Volume ($mm^3$) | | 0.44 | 0.52 | 0.55 | 0.48 | 0.44 | 0.33 |
| | HDOV ($mm^3$) | | 0.20 | 0.28 | 0.27 | 0.23 | 0.19 | 0.10 |
| | LDOV ($mm^3$) | | 0.36 | 0.45 | 0.47 | 0.40 | 0.35 | 0.74 |
| Dimple (4) | Dimple number | | 32 | 32 | 32 | 32 | 32 | 40 |
| | Diameter (mm) | | 4.02 | 4.00 | 4.00 | 4.08 | 4.00 | 4.08 |
| | Depth (mm) | | 0.13 | 0.18 | 0.20 | 0.20 | 0.21 | 0.19 |
| | Volume ($mm^3$) | | 1.11 | 1.19 | 1.31 | 1.15 | 1.16 | 1.17 |
| | HDOV ($mm^3$) | | 0.88 | 0.96 | 1.06 | 0.89 | 0.83 | 0.89 |
| | LDOV ($mm^3$) | | 0.90 | 0.95 | 1.05 | 0.91 | 0.96 | 0.94 |
| Dimple (5) | Dimple number | | 16 | 16 | 16 | 16 | 16 | 30 |
| | Diameter (mm) | | 3.88 | 3.90 | 3.90 | 3.90 | 3.90 | 3.66 |
| | Depth (mm) | | 0.17 | 0.18 | 0.19 | 0.20 | 0.21 | 0.18 |
| | Volume ($mm^3$) | | 1.01 | 1.04 | 1.11 | 1.04 | 1.06 | 0.90 |
| | HDOV ($mm^3$) | | 0.77 | 0.78 | 0.84 | 0.78 | 0.72 | 0.59 |
| | LDOV ($mm^3$) | | 0.84 | 0.87 | 0.93 | 0.85 | 0.88 | 0.78 |
| Dimple (6) | Dimple number | | 16 | 16 | 16 | 16 | 16 | 12 |
| | Diameter (mm) | | 3.20 | 3.26 | 3.20 | 3.30 | 3.10 | 3.50 |
| | Depth (mm) | | 0.14 | 0.15 | 0.16 | 0.16 | 0.15 | 0.16 |
| | Volume ($mm^3$) | | 0.43 | 0.48 | 0.50 | 0.48 | 0.47 | 0.76 |
| | HDOV ($mm^3$) | | 0.21 | 0.24 | 0.24 | 0.23 | 0.20 | 0.48 |
| | LDOV ($mm^3$) | | 0.35 | 0.39 | 0.41 | 0.40 | 0.37 | 0.65 |
| Total dimple number | | | 392 | 392 | 392 | 392 | 392 | 492 |
| Overall dimple volume ($mm^3$) | | | 306.0 | 322.5 | 351.6 | 312.3 | 320.0 | 330.6 |
| Overall HDOV ($mm^3$) | | | 215.7 | 231.1 | 250.2 | 213.1 | 202.4 | 202.2 |
| Overall LDOV ($mm^3$) | | | 253.3 | 269.9 | 293.0 | 255.6 | 279.0 | 384.4 |
| Overall HDOV/overall LDOV | | | 0.85 | 0.86 | 0.85 | 0.83 | 0.73 | 0.53 |
| Ball diameter (mm) | | | 42.7 | 42.7 | 42.7 | 42.7 | 42.7 | 42.7 |
| Ball weight (g) | | | 45.3 | 45.3 | 45.2 | 45.3 | 45.2 | 45.4 |
| Ball $\mu$ hardness (mm) | | | 2.9 | 2.9 | 2.9 | 2.9 | 2.9 | 2.9 |
| Flight | Head speed 50 m/s | Elevation angle (°) | 9.1 | 8.9 | 8.6 | 9.1 | 9.3 | 9.1 |
| | | Carry (m) | 228 | 225 | 213 | 222 | 220 | 218 |
| | | Total (m) | 249 | 252 | 247 | 248 | 239 | 243 |
| | Head speed 35 m/s | Elevation angle (°) | 10.4 | 10.3 | 10.1 | 10.4 | 10.6 | 10.3 |
| | | Carry (m) | 165 | 165 | 163 | 162 | 163 | 161 |
| | | Total (m) | 174 | 176 | 179 | 172 | 171 | 170 |

Example 1 has four types of dimple diameters of which two types have two different depths and consists of a core and a two-layer cover. Example 2 is a ball having slightly deeper dimples than Example 1. Example 3 is a ball having further deeper dimples than Example 2. Example 4 is a ball of a different cross section from Examples 1 to 3.

Comparative Example 1 is a ball of a different cross section from Examples 1 to 4 and having a small HDOV. Comparative Example 2 is a ball with a dimple arrangement completely different from the above and having a small HDOV.

As a result of hitting with a driver at a head speed of 50 m/s, the following was found.

Example 1 flies well.

Example 2 flies well despite a slightly lower trajectory than Example 1.

Example 3 follows a fairly lower trajectory than Example 1, is somewhat insufficient in carry, but rolls well on run.

Example 4 is slightly inferior to Example 1.

Comparative Example 1 flies not so far as Example 1 and Comparative Example 2.

Comparative Example 2 is inferior to Example 1.

As a result of hitting with a driver at a head speed of 35 m/s, the following was found.

Example 1 flies well.

Example 2 flies farther than Example 1.

Example 3 flies farthest.

Example 4 reaches approximately the same height as Example 1, but is slightly inferior in flight distance.

Comparative Example 1 flies not so far as Example 1, but farther than Comparative Example 2.

Comparative Example 2 is inferior to Example 1.

It was found that even when the ball was hit at a head speed of 35 m/s, the ball followed a rather skying trajectory if HDOV was small, because the initial conditions were close to the high-speed region.

What is claimed is:

1. A golf ball having a plurality of dimples having a diameter of 1.8 to 4.6 mm formed in its surface, wherein a sum of high-speed region dimple operative volumes (HDOVs) of respective dimples of the plurality of dimples as calculated by the following high-speed region formula is 210 to 310 $mm^3$, the high-speed region formula comprising, for each dimple of the plurality of dimples having a diameter $D_1$ (mm) which is the largest portion in a dimple:

determining a diameter range $R_1$ containing the diameter $D_1$ from Table 5;

horizontally slicing the dimple at a position of a depth corresponding to a diameter $D_2$ (mm) equal to a lower limit of the diameter range $R_1$, thereby defining a first slice zone $A_1$ of flat frustoconical shape having the diameters $D_1$ and $D_2$;

multiplying the volume ($mm^3$) of the slice zone $A_1$ by a coefficient $\alpha_1$ corresponding to the diameter range $R_1$ given in Table 5 wherein the coefficients corresponding to the diameter ranges which are formed by diameters of larger than 3.8 mm are assigned to the heaviest weight and other weight is reduced roughly in a parabola toward the smallest diameter range which is formed by diameters smaller than 2.0 mm, thereby calculating a first imaginary slice volume $V_1$ ($mm^3$);

horizontally slicing the dimple at a position of a depth corresponding to a diameter $D_3$ (mm) equal to the lower limit of the diameter range $R_2$ which is given one row below the preceding diameter range $R_1$ in Table 5, thereby defining a second slice zone $A_2$ of flat frustoconical shape having the diameters $D_2$ and $D_3$;

multiplying the volume ($mm^3$) of the slice zone $A_2$ by a coefficient $\alpha_2$ corresponding to the diameter range $R_2$ given in Table 5, thereby calculating a second imaginary slice volume $V_2$ ($mm^3$);

repeating the calculation of imaginary slice volumes for successive diameter ranges that are each one row below a preceding diameter range in Table 5 until the volume ($mm^3$) of a slice zone $A_n$ associated with a final diameter range $R_n$ of less than 2 mm is multiplied by a coefficient $\alpha_n$ corresponding to the diameter range $R_n$, thereby calculating an n-th imaginary slice volume $V_n$ ($mm^3$; and summing the imaginary slice volumes calculated by the high-speed region formula to obtain a high-speed region dimple operative volume HDOV, $$HDOV(\mathrm{mm}^3)=V_1+V_2+\ldots+V_n$$

TABLE 5

| Diameter range R (mm) | Coefficient α |
|---|---|
| ≧4.4 | 1.00 |
| 4.2–4.4 | 1.00 |
| 4.0–4.2 | 1.00 |
| 3.8–4.0 | 1.00 |
| 3.6–3.8 | 0.95 |
| 3.4–3.6 | 0.90 |
| 3.2–3.4 | 0.85 |
| 3.0–3.2 | 0.80 |
| 2.8–3.0 | 0.70 |
| 2.6–2.8 | 0.60 |
| 2.4–2.6 | 0.50 |
| 2.2–2.4 | 0.40 |
| 2.0–2.2 | 0.30 |
| ≦2.0 | 0.20. |

2. The golf ball of claim 1, wherein a sum of low-speed region dimple operative volumes (LDOVs) of respective dimples of the plurality of dimples as calculated by the following low-speed region formula is 210 to 310 mm, the low-speed region formula comprising, for each dimple of the plurality of dimples having a diameter $D_1$ (mm):

determining a diameter range $R_1$ containing the diameter $D_1$ from Table 6;

horizontally slicing the dimple at the position of a depth corresponding to a diameter $D_2$ (mm) equal to the lower limit of the Table 6 diameter range $R_1$, to define a first slice zone $A_1$ of flat frustoconical shape having the diameters $D_1$ and $D_2$;

multiplying the volume ($mm^3$) of the slice zone $A_1$ by a coefficient $\beta_1$ corresponding to the diameter range $R_1$ given in Table 6 wherein the coefficients corresponding to the diameter ranges which are formed by diameters of 2.6 to 3.0 mm are assigned to the heaviest weight and other weight is reduced roughly in a parabola toward the largest diameter range formed by diameters larger than 4.4 mm and the smallest diameter range formed by diameters smaller than 2.0 mm, thereby calculating a first imaginary slice volume $v_1$ ($mm^3$);

horizontally slicing the dimple at a position of a depth corresponding to a diameter $D_3$ (mm) equal to the lower limit of the diameter range $R_2$ which is given one row below the preceding diameter range $R_1$ in Table 6, to define a second slice zone $A_2$ of flat frustoconical shape having the diameters $D_2$ and $D_3$;

multiplying the volume ($mm^3$) of the slice zone $A_2$ by a coefficient $\beta_2$ corresponding to the diameter range $R_2$ given in Table 6, thereby calculating a second imaginary slice volume $v_2$ ($mm^3$);

repeating the calculation of imaginary slice volumes for successive diameter ranges that are each one row below a preceding diameter range in Table 6 until the volume ($mm^3$) of the slice zone $A_n$ associated with the final diameter range $R_n$ of less than 2 mm is multiplied by a coefficient $\beta_n$ corresponding to the diameter range $R_n$, thereby calculating an n-th imaginary slice volume $v_n$ ($mm^3$); and summing the imaginary slice volumes calculated by the low-speed region formula to obtain a low-speed region dimple operative volume LDOV, $$LDOV(mm^3)=v_1+v_2+\ldots+v_n$$

TABLE 6

| Diameter range R (mm) | Coefficient β |
|---|---|
| ≧4.4 | 0.10 |
| 4.2–4.4 | 0.20 |
| 4.0–4.2 | 0.40 |
| 3.8–4.0 | 0.60 |
| 3.6–3.8 | 0.70 |
| 3.4–3.6 | 0.80 |
| 3.2–3.4 | 0.90 |
| 3.0–3.2 | 0.95 |
| 2.8–3.0 | 1.00 |
| 2.6–2.8 | 1.00 |
| 2.4–2.6 | 0.90 |
| 2.2–2.4 | 0.80 |
| 2.0–2.2 | 0.70 |
| <2.0 | 0.50. |

3. The golf ball of claim 2, wherein a ratio of the sum of high-speed region dimple operative volumes to the sum of low-speed region dimple operative volumes is from 0.8/1 to 1.0/1.

4. The golf ball of claim 1, wherein an overall dimple volume for the plurality of dimples is 250 to 400 $mm^3$.

5. The golf ball of claim 1, further comprising:

a solid core formed of a rubber composition and having a diameter of 34 to 40 mm; and a cover enclosing the core.

6. The golf ball of claim 5, wherein the cover has two layers or three layers.

7. The golf ball of claim 6, wherein the cover is formed of thermoplastic resin selected from ionomer resins, thermoplastic polyurethane elastomers, and thermoplastic polyester elastomers.

8. The golf ball of claim 6, wherein a layer of the cover next to an outermost layer is formed of ionomer resins.

9. The golf ball of claim 6, wherein an outermost cover layer has Shore D hardness of 40 to 52 and a cover layer next to the outermost cover layer has Shore D hardness of 50 to 63.

10. The golf ball of claim 6, wherein an outermost cover layer has a gage of 1.0 to 2.0 mm.

11. The golf ball of claim 6, wherein a cover next to an outermost cover layer has a gage of 1.0 to 2.0 mm.

12. The golf ball of claim 6, wherein the cover has an overall gage of 2.0 to 4.0 mm.

13. The golf ball of claim 1, wherein the golf ball has a compression deformation of 2.6 to 3.4 mm when a load that varies from an initial load of 10 kg to a final load of 130 kg is applied to the ball.

14. The golf ball of claim 1, further comprising a solid core formed of polybutadiene rubber and a cover enclosing the core which is formed of an inside cover layer composed primarily of ionomer resin and an outside cover layer composed primarily of thermoplastic polyurethane elastomer.

15. The golf ball of claim 1, wherein the diameter $D_1$ is 1.8 to 4.6 mm, and each dimple of the plurality of dimples has a depth from 0.12 to 0.22 mm.

16. The golf ball of claim 1, wherein the plurality of dimples includes combinations of at least four different types of dimples which are different in diameter.

17. The golf ball of claim 1, wherein a total number of the plurality of dimples is from 390 to 400.

* * * * *